United States Patent [19]

Hane et al.

[11] 4,114,282

[45] Sep. 19, 1978

[54] VERTICAL CENTERING METHOD AND JIG FOR PLATING

[75] Inventors: Yoshio Hane, Kawasaki; Nobuo Chino, Komae; Katsuhiro Murata; Akira Harayama, both of Okaya, all of Japan

[73] Assignees: Taisei Kensetsu Kabushiki Kaisha; Teikoku Piston Ring Co., Ltd., both of Japan

[21] Appl. No.: 669,453

[22] Filed: Mar. 22, 1976

[30] Foreign Application Priority Data

Apr. 14, 1975 [JP] Japan ..... 50-44233

[51] Int. Cl.[2] ..... G01B 3/30

[52] U.S. Cl. ..... 33/180 R; 204/297 R

[58] Field of Search ..... 204/297 R, 297 W; 33/180 R, 181 AT, 180 AT, 181 R, 185 V

[56] References Cited

U.S. PATENT DOCUMENTS

| | | | |
|---|---|---|---|
| 1,022,487 | 4/1912 | Lutz | 204/297 W |
| 2,396,383 | 3/1946 | Moore | 33/172 A UX |
| 2,471,106 | 5/1949 | Hall | 33/181 AT |
| 3,391,596 | 7/1968 | Baker et al. | 33/402 |

*Primary Examiner*—Harry N. Haroian

*Attorney, Agent, or Firm*—Wenderoth, Lind & Ponack

[57] ABSTRACT

When plating an outer surface of a cylindrical article or an inner surface of a tubular article, in order to automatically achieve centering between the article to be plated and the opposed tubular or cylindrical electrode, there is provided a novel jig for supporting the cylindrical body, either the article to be plated or the opposed electrode, at the center of the tubular body, either the opposed electrode or the article to be plated, and a method for automatically centering the cylindrical body and the tubular body by means of said jig. The jig consists of a jig receiving member having a jig supporting surface in the form of an inclined surface or a spherical surface having a center axis, and a jig member having a surface by which the jig member is to be supported which is mated with the jig supporting surface and which is coaxial with the center axis of the jig supporting member, and the pair of mating surfaces serve as electric conduction means between the cylindrical body and an external circuit. The automatic centering method is made up of the steps of supporting the jig member on the jig supporting surface of the jig receiving member, and subsequently applying vibrations to the pair of mating surfaces to thereby bring the center axis of the jig member to a vertical position.

4 Claims, 3 Drawing Figures

VERTICAL CENTERING METHOD AND JIG FOR PLATING

Figure 1:
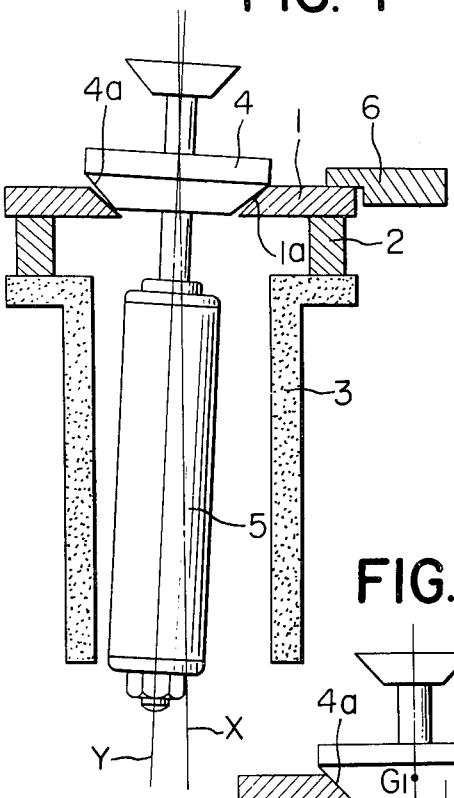

The present invention relates to a centering method in which a movable jig member is fitted into one fixed jig member by either manual or automatic loading in such a way as to align the center axes of the respective jig members.

For instance, when hard chromium plating is carried out on a peripheral surface of a piston ring for the purpose of enhancing its wear-resisting property, in addition to severe requirements for close adhesion of the plating and the like, a high precision in such dimensions as the thickness of the plating is required. In general, when plating rings, a great number of rings are mounted on a jig being piled up in the form of a cylinder, and then the external peripheral surfaces are plated. In such a case, in order to satisfy the severe requirement for precise dimensions, it is essential to precisely determine the relative positioning of the article to be plated consisting of rings piled up in the form of a cylinder as described above and serving as a cathode, with respect to an anode. If this centering process is incomplete, various deficiences occur such that the thickness of the plating becomes uneven resulting in the necessity for excessive grinding and lapping, or that because of insufficient thickness of plating, unacceptable products are produced and re-plating is required. Likewise there can occur the problems of uneven quality of plating and insufficient close adhesion due to improper distances between the electrodes.

Heretofore, various methods for resolving these problems have been proposed, and by way of example, a method is known in which plating is carried out while rotating the article to be plated. However, the mechanism for carrying out this method is very complex and it becomes a large obstacle to automation.

The present invention has been proposed in the light of the aforementioned drawbacks, and according to the invention there is provided a vertical centering method characterized by the steps of supporting on a jig supporting surface on a jig receiving member, which jig supporting surface is an inclined surface or a spherical surface having a vertical center axis, a jig member having a surface complementary to said jig supporting surface, and subsequently applying vibrations to the pair of opposed surfaces consisting of the jig supporting surface on the jig receiving member and the surface to on the jig member, to thereby bring the center axis of said jig member to a vertical position.

According to the above-described feature of the present invention, since the center axis of the jig supporting surface provided on the jig receiving member is vertical and said jig supporting surface is an inclined surface or a spherical surface, the surface on the jig member by which the jig member is to be supported which is an inclined surface or a spherical surface complimentary to the jig supporting surface of said jig receiving member, when vibrations are subsequently applied to said pair of complementary surfaces, the inclined surface or spherical surface on the jig member would gradually shift so as to mate with the inclined or spherical jig supporting surface on the jig receiving member, and eventually the two surfaces will be in perfect mating abutment. Moreover, since the center axis of the jig supporting surface on said jig receiving member vertical, the center axis of the jig member will also, when the surface thereon is in mating abutment with said jig supporting surface, be maintained in a vertical position, and thereby vertical centering of a member supported by said jig member and a member supported by said jig receiving member can be achieved automatically.

According to the method of the present invention, vertical centering can be achieved automatically be means of such a simple structure, and therefore, the present invention is really useful.

Figure 2:
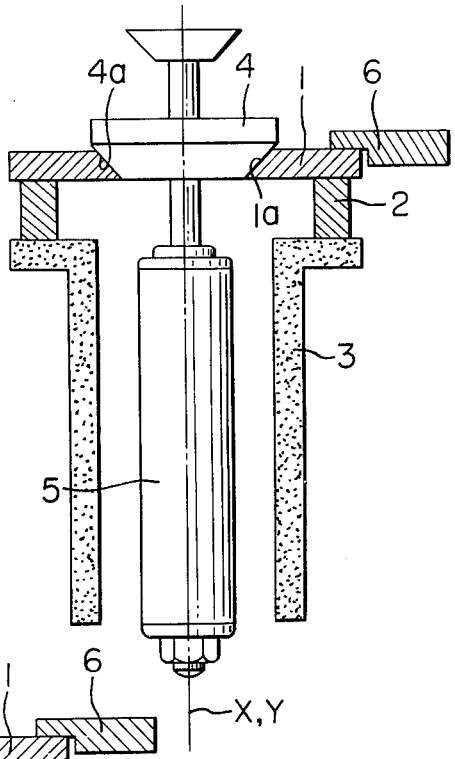
Figure 3:
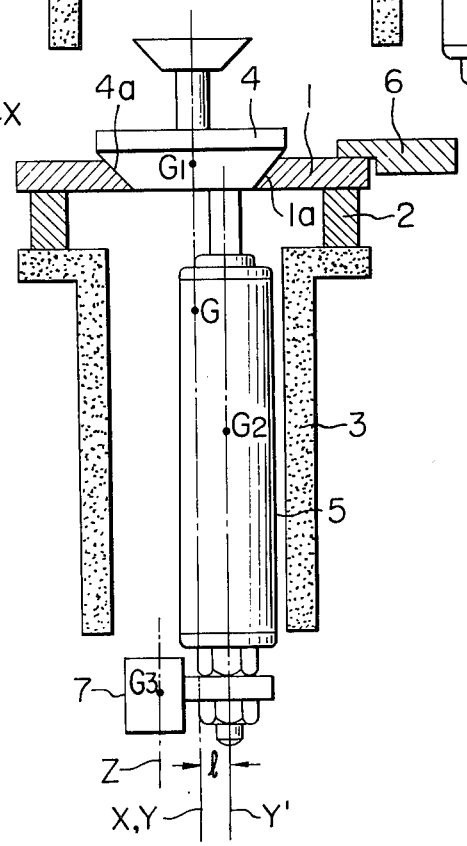

The foregoing and other features and advantages of the invention will become more apparent by reference to the following specification taken in conjunction with the accompanying drawings, in which:

FIGS. 1 and 2 are longitudinal cross-section views showing the structure of the parts of the jig the steps of the method in one preferred embodiment of the present invention as applied to plating of piston rings, and FIG. 3 is a longitudinal cross-section view showing a modified embodiment of the jig of the present invention.

Now the present invention will be described in connection with the illustrated embodiment in which the invention is applied to plating of piston rings. Referring to the drawings, reference numeral 1 designates a jig receiving member constituting a cathode electrode, at the center of which is provided a bore 1*a* having a frusto-conical surface with a diameter gradually decreasing towards the bottom and constituting a jig supporting surface having a vertical center axis S, and said jig receiving member 1 has a cylindrical anode electrode 3 depending from an insulator 2 on the cathode electrode with the center axis aligned with the axis of bore 1*a*.

Reference numeral 4 designates a jig member having a frusto-conical surface 4*a* by which it is supported and which is complementary to the shape of the surface defining the bore 1*a* provided in said jig receiving member 1, and on said jig member 4 is mounted a cylindrical body 5 consisting of a plurality of piston rings to be plated piled up in the form of a cylinder with the center axis Y of said cylindrical body 5 and the center axis Y of the jig member 4 aligned with each other when the complementary surfaces 1*a* and 4*a* are perfect mating abutment. The taper of the frusto-conical supporting surface 1*a* on said jig receiving member 1 and the frusto-conical surface on said jig member 4 should preferably be at an angle from 30° to 120°, and more preferably, the optimum value is within the range of 50° to 70°. Furthermore, in one preferred embodiment, the most desirable value is 60°.

The jig member 4 having said cylindrical body 5 mounted thereon is loaded into said jig receiving member 1 and the anode electrode 3 from above by means of a carrier, a lift or the like, and the surface 4*a* on the jig member 4 is fitted into the bore 1*a* in the jig receiving member 1. Generally, however, a deviation occurs between the center axis Y of said jig member 4 and cylindrical body 5 and the center axis Y of the bore 1*a* in the jig receiving member 1. At this time if vibrations are applied to said jig receiving member 1 and said jig member 4 by means of a vibrator 6 as shown in FIG. 1, then the surface 4*a* of the jig member 4 gradually comes into perfect mating engagement with the inner circumferential surface of the bore 1*a* in the jig receiving member 1, and eventualy the former will tightly abut the latter, resulting in perfect alignment of the center axes X and Y of the respective members (See FIG. 2). Then, since the center axis X of said bore 1*a* is directed precisely in the vertical direction, the center axis Y of the jig member 4 and the cylindrical body 5 is also directed vertically, and even if further vibrations are applied, the vertical alignment will be maintained.

It has been proved that the evenness of the thickness and the quality of the plating layer on the piston rings which are hard chromium plated by employing the above-described centering method is quite satisfactory.

While a plating of uniform thickness is desirable in most cases as described above, in some cases it is desired to intentionally vary the thickness of the plating on a cylindrical surface at different angular positions on the cylindrical surface. The present invention can also be used in such cases. A modified embodiment for achieving such a result is illustrated in FIG. 3, in which the center axis Y' of the cylindrical body 5 is offset from and parallel to the center axis Y of the frusto-conical surface 4*a* of the jig member 4, and thereby the thickness of the plating layer formed on the outer surface of said cylindrical body 5 can be varied in a desired manner.

Reference numeral 7 designates a balance weight attached to the lower end of the cylindrical body 5, in order to bring the overall center of gravity G, which is a composite of the centers of gravity $G_1$, $G_2$ and $G_3$ of the jig member 4, the cylindrical body 5 and the balance weight 7, respectively, onto the center axis Y of the jig member 4.

It is to be noted that due to the vibration applied by the vibrator 6, the jig member 4 serving as the cathode will underrgo a rotary or rocking motion about the center axis X, and the pair of corresponding frusto-conical surface 1*a* and 4*a* will be aligned with each other. Consequently, an improvement in electrical conductivity caused by the fitting effect is achieved, and because the contact area between said mating frusto-conical surfaces is increased, the jig receiving member 1 can function satisfactorily as electrical conduction means for the cathode 4.

While one preferred embodiment of the present invention as applied to plating of piston rings has been described above, the invention is equally applicable, ofr example, to plating of the outer circumferential surface of a roll, a rod and the like, and further it is possible to plate the inner circumferential surface of tubular bodies such as various cylinders by reversing the anode and cathode connections, that is, by mounting an anode electrode on the jig member 4 and substituting an article to be plated for the electrode 3.

As will be seen from the above-described embodiments, the deviation between the center axes of the jig member and the jig receiving member can be eliminated to a certain extent simply by providing a pair of frusto-conical mating surfaces, if great precision is required in positioning by the use of the jig. However, there exists a problem in the enhancement of the precision of positioning by the use of the jig, and it is difficult to assure the precision. Furthermore, due to the efects of the coefficient of friction between said frusto-conical mating surfaces, the weight of the jig member and the like, sometimes the provision of only said frusto-conical mating surfaces is not sufficient for correcting the deviation between the respective center axes. The present invention is characterized by the application of vibrations of a fixed intensity to the pair of frusto-conical mating surfaces, whereby the correction of the deviation between center axes is facilitated and the precision of the adjustment is enhanced.

As described above, the following effects and advantages of the present invention can be enumerated, and since excellent effects which cannot be achieved in the prior art can be achieved with relatively simple means, the practical value of the invention is very high:

1. Automatic vertical centering of a heavy article becomes possible.
2. Since the centering by automatic loading becomes possible, completely attendant free operation can be achieved even in an apparatus which necessitates a high precision of centering.
3. In the case of hard chromium plating, a uniform thickness of plating and a uniform quality of plating can be assured. Accordingly, the grinding, lapping and honing work is reduced, and also production of unacceptable products due to insufficient thickness of plating can be prevented.
4. By providing a pair of conical mating surfaces, the size of the contact area between the jig member and the jig receiving member is increased, and these contact surfaces can be utilized as electrical conduction means. In the case of hard chromium plating, the electrical conductivity of the electrical conduction means in the jig receiving member with respect to the jig member (cathode) can be enhanced.
5. Since the precision of loading of the jig member is increased, simplification of the conveying means can be realized.

It is to be noted that the present invention is widely applicable to vertical centering between a fixed jig member and a movable jig member which necessitate a high centering precision, and the conical mating surfaces can be utilized as electrical conduction means.

Since many changes could be made in the above construction and many apparently widely different embodiments of this invention could be made without departing the scope thereof, it is intended that all matter contained in the above description or shown in the accompanying drawings shall be interpreted as illustrative and not in a limiting sense.

What is claimed is:

1. A method for centering a cylindrical member to be plated within a hollow vertically arranged cylindrical plating electrode so that the longitudinal axis of the cylindrical member to be plated is aligned with the vertical axis of the cylindrical plating electrode, which method comprises:

securing on the top of the vertical plating electrode a horizontal jig receiving member having a circular hole therein, said hole being defined by a surface tapering downwardly and inwardly toward the vertical axis of the cylindrical plating electrode, arranging said hole so that the geometric center is aligned with a longitudinal axis within said electrode;

securing on one end of the cylindrical member to be plated a disc-shaped jig member having a tapering peripheral surface engagable in tight mating fit with the circular hole-defining surface; with said disc-shaped jig member being perpendicular to the longitudinal axis of the cylindrical member to be plated, said hole-defining surface and said tapering peripheral surface having a shape for fixing the disc-shaped jig member horizontally in said jig receiving member when said surfaces are in tight mating fit;

inserting said cylindrical member to be plated into the hollow interior of the cylindrical plating electrode with said jig member gravitationally suspending said cylindrical member within said electrode in such a manner that the peripheral surface of said jig member is brought into provisional imperfect engagement with the hole-defining surface of the jig receiving member; and vibrating said jig receiving member and vibrating said jig member through the jig receiving member to bring the peripheral surface of said jig member into said tight mating engagement with the hole-defining surface of said jig receiving member through the effect of said gravitational suspension.

2. The method as claimed in claim 1 in which said cylindrical member and said jig member are connected to each other and said hole is positioned relative to the central axis of said hollow cylindrical plating electrode so that the axis of the cylindrical member is coaxial with the axis of said hollow cylindrical plating electrode when the cylindrical member and the electrode are aligned.

3. The method as claimed in claim 1 in which said cylindrical member and said jig member are connected to each other at a point offset from the central axis of said hole, and a balance weight is mounted on said cylindrical member for causing said cylindrical member to swing readily by the vibrations.

4. The method as claimed in claim 1 in which a plurality of ring-like articles to be plated are assembled into a cylinder constituting said cylindrical member.

* * * * *